US006382760B1

(12) United States Patent
Peter

(10) Patent No.: US 6,382,760 B1
(45) Date of Patent: May 7, 2002

(54) AIR VANE COOLING SYSTEM FOR THERMAL INKJET PRINTERS WITH MOVING MOVABLE CARRIAGES

(75) Inventor: Kenneth C. Peter, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/714,612

(22) Filed: Nov. 17, 2000

(51) Int. Cl.[7] ..... B41J 29/377
(52) U.S. Cl. ..... 347/18
(58) Field of Search ..... 347/18, 21, 102; 101/424.1, 487

(56) References Cited

U.S. PATENT DOCUMENTS 5,936,646 A * 8/1999 Kenny et al. ..... 347/18
6,065,823 A * 5/2000 Kawamura ..... 347/18

* cited by examiner

*Primary Examiner*—Craig A. Hallacher
(74) *Attorney, Agent, or Firm*—Oliff & Berridge, PLC

(57) ABSTRACT

An air vane directs air to cool the printhead of thermal inkjet printers having one or more movable carriages. A passive air vane is mounted on or molded to some portion of the carriage, printhead, ink tank or ink tank holder so that it moves with the movable carriage. Moving the air vane significantly increases the flow of air over the printhead, increasing the flow of heat away from the printhead and, consequently, improving the performance of the printer.

12 Claims, 4 Drawing Sheets

AIR VANE COOLING SYSTEM FOR THERMAL INKJET PRINTERS WITH MOVING MOVABLE CARRIAGES

BACKGROUND OF THE INVENTION

1. Field of Invention

The invention relates generally to thermal fluid ejectors with movable carriages.

2. Description of Related Art

Conventional thermal fluid ejectors with movable carriages have elements that are cooled through a physical connection to a heat sink and through natural heat convection from the heat sink to the ambient environment as the movable carriage moves over the guide rail. In some fluid ejector systems, this natural cooling becomes insufficient during times of high workload, such that the ejection elements tend to overheat. When the ejection elements start to overheat, some thermal fluid ejector systems are designed to automatically reduce the effective workload by decreasing the ejection rate, such that the natural cooling of the fluid ejectors again, becomes sufficient.

SUMMARY OF THE INVENTION

Improving the heat transfer away from the ejection elements would tend to solve this overheating problem. Such improvements would reduce the need for automatic reductions in the effective workload.

This invention provides systems and methods that improve the effective heat transfer rate from one or more thermal fluid ejectors of a fluid ejection system.

This invention separately provides systems and methods for increasing the effective heat transfer rate of heat generated by a thermal fluid ejector directly to the ambient atmosphere.

This invention separately provides systems and methods that increase effective flow rates of the ambient atmosphere over one or more thermal fluid ejectors of a fluid ejection system.

This invention separately provides one or more deflectors that direct a flow of ambient atmosphere across one or more printheads of a fluid ejector as a carriage on which the one or more thermal fluid ejectors are mounted moves during printing.

In various exemplary embodiments of the systems and methods according to this invention, a thermal fluid ejector cooling system improves the cooling of the thermal fluid ejector by taking advantage of the reciprocating motion of the movable carriage to increase the flow of the ambient atmosphere over the heat sink and/or one or more of the thermal fluid ejectors. The improved cooling obtained according to the systems and methods of this invention can be substantial and can decrease or even eliminate the need to automatically adjust the effective workload.

In various exemplary embodiments, the cooling systems according to this invention includes a passive structure, such as an air vane, that moves with the movable carriage and uses that movement to re-direct the ambient atmosphere to flow over the fluid ejector heads. The passive structure may be constructed of a variety of materials and may be an integral part of a thermal fluid ejection system or an add-on to an existing thermal fluid ejection system.

These and other features and advantages of this invention are described in, or are apparent from, the following detailed description of various exemplary embodiments of the systems and methods according to this invention.

BRIEF DESCRIPTION OF THE DRAWINGS

Various embodiments of this invention will be described in detail, with reference to the following figures, wherein.

DETAILED DESCRIPTION OF THE INVENTION

Figure 1:
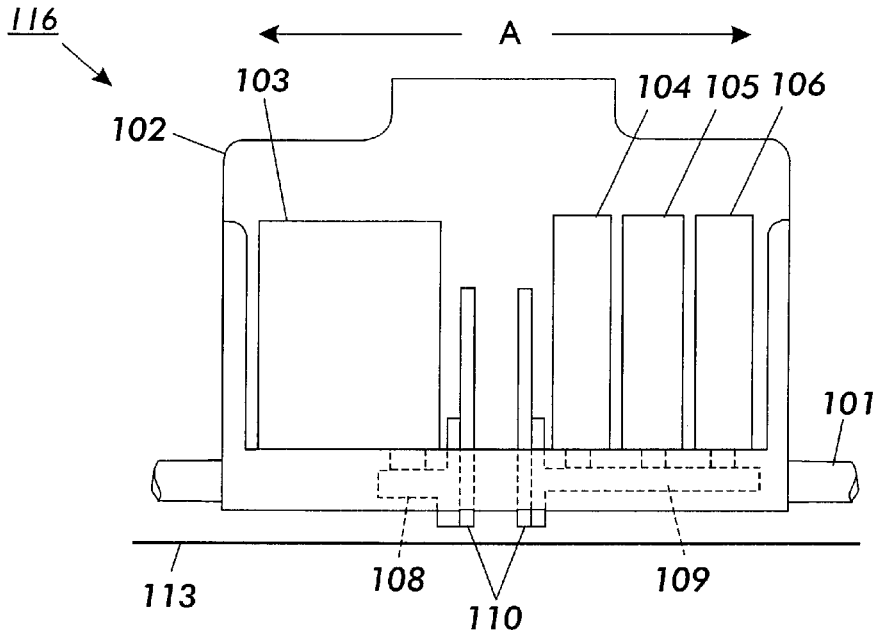
FIG. 1 is a plan view of a conventional fluid ejection system.

FIG. 1 illustrates one exemplary embodiment of a conventional thermal fluid ejection system 100, such as for example a thermal inkjet printer, that includes one or more thermal fluid ejectors, one or more guide rails 101, a movable carriage 102, a number of fluid tanks 103–106, and one or more heat sinks 110, as are conventionally found in thermal inkjet printers with movable carriages. The one or more guide rails 101, usually comprising at least one rectangular or cylindrical metallic bar, are rigidly fixed to a housing (not shown) of the thermal fluid ejection system. A fluid ejection head 115 includes one or more thermal fluid ejectors 108 and 109 and zero, one or more heat sinks 110. A movable carriage assembly 116 includes the movable carriage 102 and those elements mounted on or supported by the movable carriage 102. Elements mounted on or supported by the movable carriage may include but are not limited to at least one fluid ejection head 115 and at least one of the fluid tank 103–106.

Figure 3:
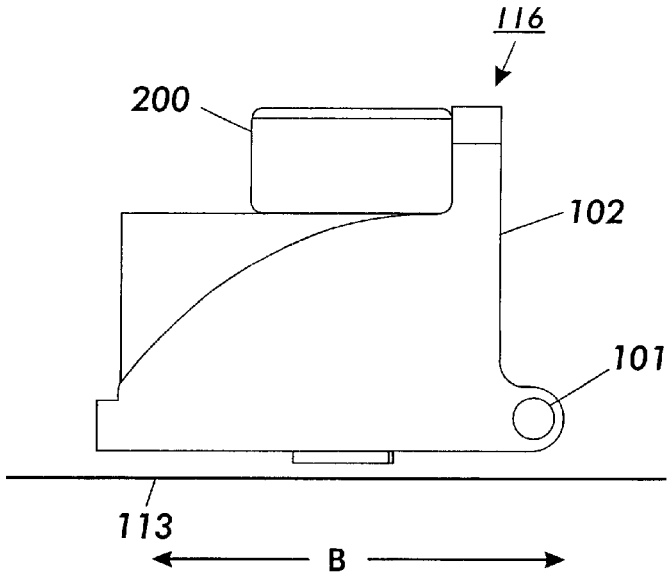
FIG. 3 is a side view of the fluid ejection system shown in FIG. 2.

During operation, the movable carriage 102 is driven back and forth along the one or more guide rails 101 in a fast scan direction A. As shown in FIGS. 1 and 3, a fluid receiving medium 113 moves in a process direction B that is perpendicular to the fast scan direction A. As the movable carriage 102 moves back and forth along the one or more guide rails 101 along the fast scan direction A, the fluid ejector heads 108 and 109 expel fluid received from the fluid tanks 103–106 onto the exposed face of the fluid receiving medium 113 and generate a desired pattern of expelled fluid onto the fluid receiving medium 113.

During fluid ejection operations of the thermal fluid ejection system 100, the thermal fluid ejector heads 108 and 109 use thermal energy in methods well known in the industry to increase the temperature of the fluid to be expelled and to generate bubbles that cause droplets of the fluid to be expelled through nozzles of the fluid ejector heads 108 and 109. This usually entails applying heat energy to keep the fluid ejector heads 108 and 109 within a predetermined operating temperature range. Additional heat energy is temporarily applied to generate fluid vapor bubbles in one or more ejector channels of the fluid ejector heads 108 and 109. These fluid vapor bubbles eject droplets of the fluid through nozzles ending the ejector channels of the fluid ejector heads 108 and 109. As a result, a desired pattern of fluid droplets is generated on the fluid receiving medium 113.

Heat is conducted away from the fluid ejector heads 108 and 109 through the one or more heat sinks 110, if provided, that are in physical contact with the fluid ejector heads 108 and 109. Heat is convected away along the surface of the heat sinks 110, if provided, and, to a lesser extent is some exemplary embodiments, along the surface of the fluid ejector heads 108 and 109, as heated gases in the ambient atmosphere naturally rise and as the ambient atmosphere flows past the one or more heat sinks 110, and/or the fluid ejector heads 108 and 109, with each movement of the movable carriage 102 along the one or more guide rails 101. During normal use of such conventional thermal fluid ejection systems 100, this arrangement is sufficient to keep the operating temperature within the temperature limits predetermined for optimal fluid ejection functions and acceptable life of the fluid ejector heads 108 and 109.

However, in some fluid ejection systems 100, for example during periods of sustained and/or heavy use, the actual operating temperature tends to increase beyond the predetermined operating temperature range. When this happens, fluid ejection functions tend to degenerate, as the size of the fluid droplets to be expelled is highly dependent upon temperature. The useful life of the fluid ejection heads 108 and 109 also tends to be negatively affected, as the electronic elements contained in the ejection head 115 can be sensitive to sustained elevated temperatures. Some fluid ejection systems 100 are designed to lower the effective workload during periods of overheating by reducing ejection speeds, so that the cooling system is again able to effectively cool the fluid ejection heads 108 and 109. Although this solution is to be desired over the problem, such an arrangement trades one negative performance characteristic for another negative performance characteristic.

Figure 2:
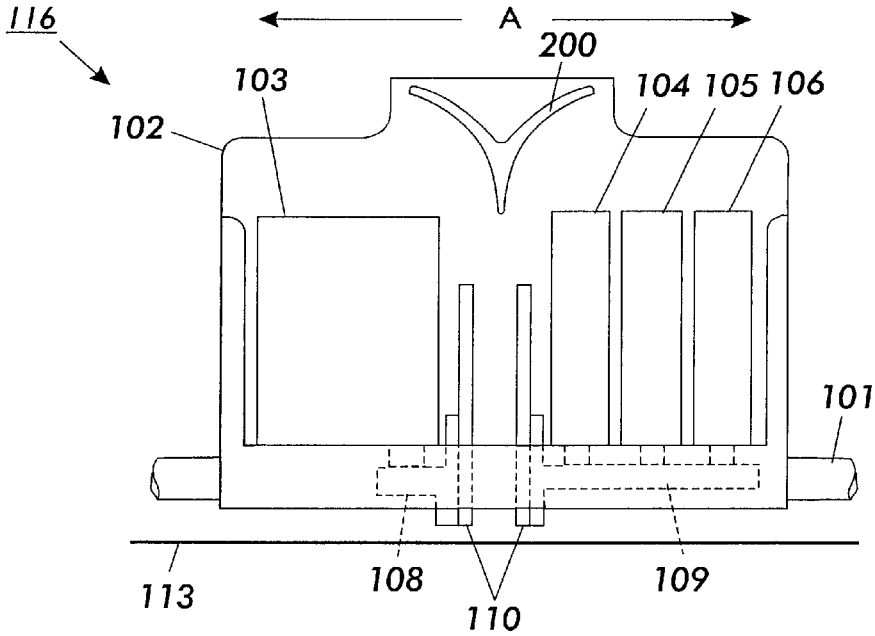
FIG. 2 is a plan view of one exemplary embodiment of a fluid ejection system incorporating a first exemplary embodiment of the cooling systems according to this invention.
Figure 4:
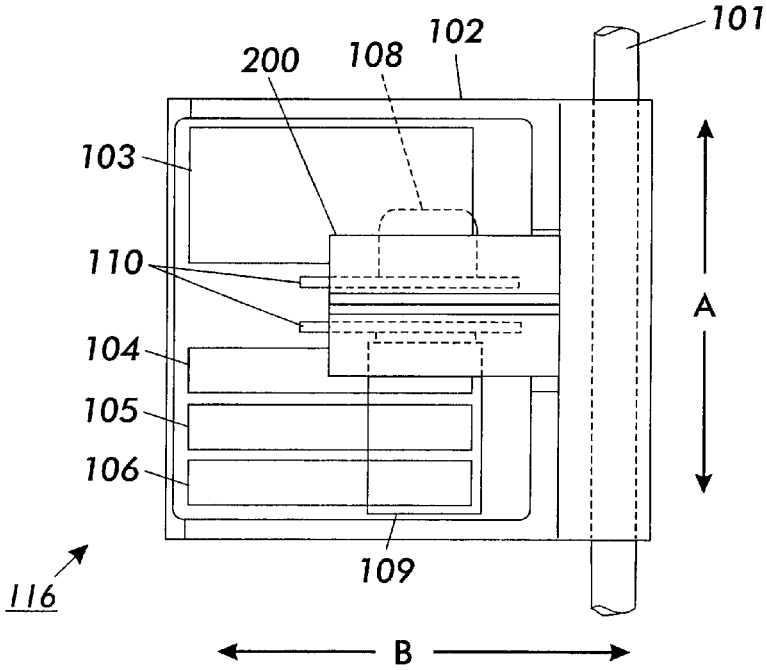
FIG. 4 is a top plan view of the ejection system shown in FIG. 2.

The various exemplary embodiments of the cooling systems according to this invention increase the flow of the ambient atmosphere over the ejection head 115 as the movable carriage 102 moves back and forth along the one or more guide rails 101 in the fast scan direction A. FIGS. 2–4 illustrate one embodiment of the fluid ejection system 100 that incorporates a first exemplary embodiment of a cooling system 200 according to this invention.

As shown in FIGS. 2–4, in this exemplary embodiment, the movable carriage assembly 116 is equipped with a multi-curved vane 200 that is attached to a portion of the movable carriage 102. The multi-curved vane 200 may be of any shape that is suitable to increase the flow of the ambient atmosphere to the ejection head 115 as the movable carriage 102 moves back and forth along the one or more guide rails 101 in the fast scan direction A. In various exemplary embodiments, the multi-curved vane 200 may be made of any suitably light and/or durable material. In various exemplary embodiments, the improved cooling provided by the multi-curved vane 200 reduces the operating temperature of the ejection head 115 relative to the exemplary embodiment shown in FIG. 1 for any given rate of movement of the movable carriage assembly 116 along the guide rails 101 and reduces or eliminates the need to reduce the effective level of use.

Figure 5:
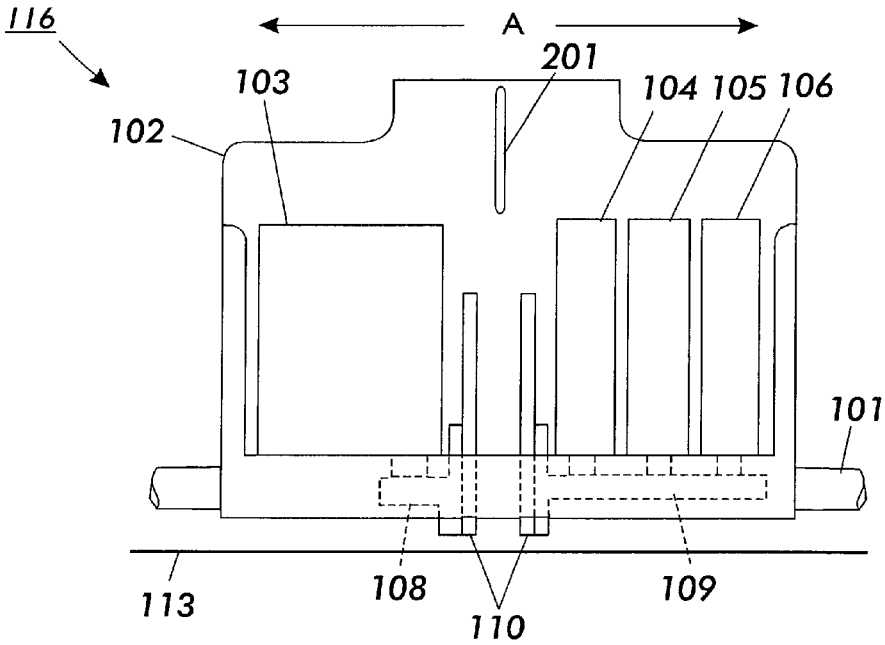
FIG. 5 is a plan view of one exemplary embodiment of a fluid ejection system incorporating a second exemplary embodiment of the cooling systems according to this invention.

It should be appreciated that the shape of the multi-curved vane 200 can vary as well as the as the manner and location of its attachment. FIG. 5 is a plan view of one exemplary embodiment of a fluid ejection system incorporating a second exemplary embodiment of the cooling systems according to this invention. As shown in FIG. 5, instead of the multi-curved vane 200 shown in FIGS. 2–4, the cooling system according to this invention is implemented using a single, straight vane 201. The straight vane 201, like the multi-curved vane 200, redirects the ambient atmosphere to improve the cooling of the ejection head 115.

Figure 6:
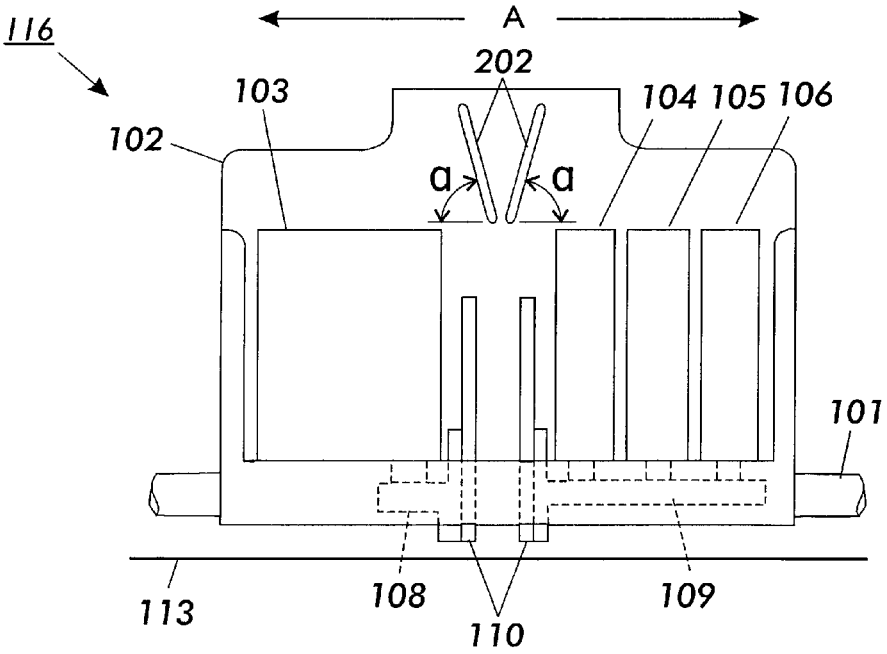
FIG. 6 is a plan view of a fluid ejection system incorporating a third exemplary embodiment of the cooling systems according to this invention.
Figure 7:
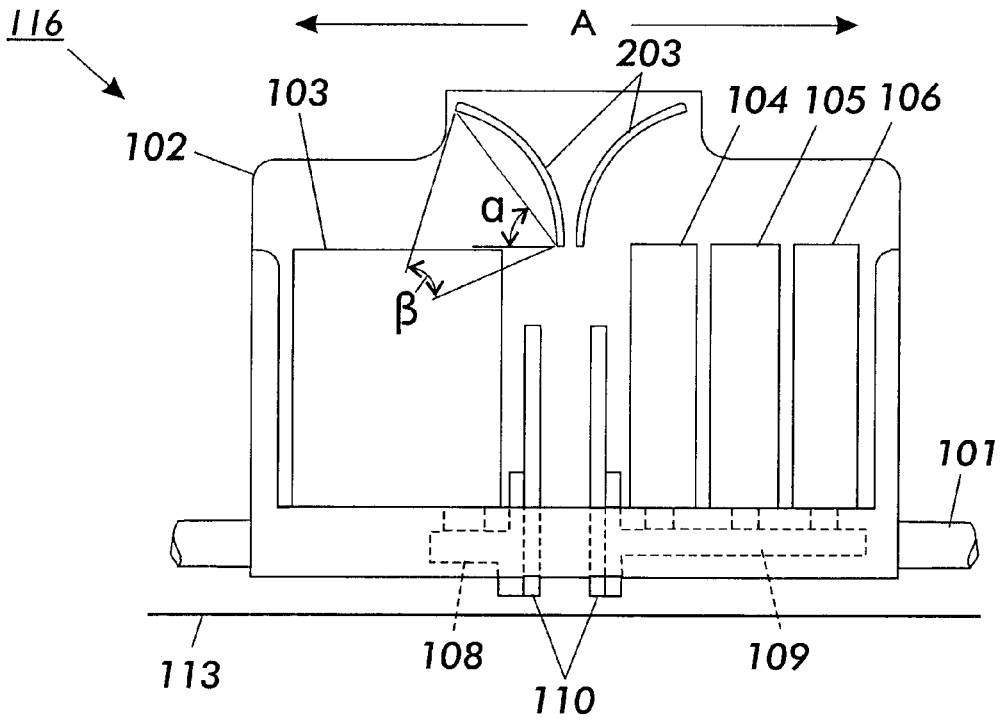
FIG. 7 is a plan view of one exemplary embodiment of a fluid ejection system incorporating a fourth exemplary embodiment of the cooling systems according to this invention.

FIGS. 6 and 7 are plan views of one exemplary embodiment of a fluid ejection system incorporating third and fourth exemplary embodiments of the cooling systems according to this invention. As shown in FIGS. 6 and 7, the second and third exemplary embodiments of the cooling systems according to this invention include a plurality of vanes 202 and 203, respectively. In particular, in FIG. 6, the plurality of vanes, or more generally, passive structures, 202 are straight structures that are set at an angle $\alpha$ and relative to the direction of travels along the fast scan direction A. Of course, the flow of ambient atmosphere across the fluid ejection head is increased or decreased in accordance with the shape of each passive structure and the angle $\alpha$ at which it is attached.

However, the invention is not limited to the exemplary embodiments portrayed in FIGS. 6 and 7. Neither the size, shape or number of passive structures nor the manner of attachment is limited to that discussed above. Further, the angles of attachment for each passive structure may be the same, as portrayed in FIGS. 6 and 7 or each passives structure may be located at a different angle $\alpha$ to the fast scan direction A. Multiple passive structures, such as those described above, allow improved redirection of the ambient atmosphere regardless of the direction of the movable carriage 102.

The passive structure 200–203 could be formed as a molded portion of the movable carriage 102 of a fluid ejection system as manufactured, or could be implemented as separate structures attached to the movable carriage 102 of an existing fluid ejection system. Such separate structures could be attached using any number of well known attaching materials, structures and/or devices, such as glue, screws and/or velcro. Also, it should be appreciated that the attachment location for the passive structures 200–203 is not limited to the portion of the movable carriage 102 depicted in FIGS. 2–7. It should be appreciated that the passive structures 200–203 can be located on another portion of the movable carriage 102, as well as any part supported by the movable carriage 102. Finally, it should be appreciated that the passive structures 200–203 are not limited to single passive structures. Obviously, the passive structures 200–203 can include any number of similar passive structures arranged to increase air flow over the fluid ejection head 115.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A device that cools at least one ejection head of a fluid ejection system having at least one movable carriage, comprising:

a mounting structure that moves with the moveable carriage; and a passive structure, fixed to the mounting structure, that forces ambient gases to flow over the at least one ejection head as the mounting structure and passive structure move with the movable carriage.

2. The device of claim 1, wherein the mounting structure is a portion of the carriage.

3. The device of claim 1, wherein the passive structure is fixed to the mounting structure such that the plane of greatest geometric area is substantially perpendicular to the path of the printer carriage.

4. The device of claim 3, wherein the passive structure is at least one flat vane.

5. The device of claim 3, wherein the passive structure is at least one multi-curved vane.

6. The device of claim 1, wherein the passive structure is a plurality of vanes fixed to the mounting structure.

7. The device of claim 6, wherein each of the plurality of vanes is a flat vane, the plurality of vanes having an angular arrangement that forces air to flow over at least one ejection head as the at least one movable carriage moves along the path in either direction.

8. The device of claim 6, wherein each of the plurality of vanes is a curved vane, the plurality of curved vanes having an arrangement that forces air to flow over at least one ejection head as the at least one movable carriage moves along the path in either direction.

9. The device of claim 1, wherein the mounting structure is at least one heat sink.

10. The device of claim 1, wherein the mounting structure is at least one ink tank.

11. The device of claim 1, wherein the mounting structure is at least one ink tank cover.

12. The device of claim 1, wherein the fluid ejection system is a thermal fluid ejection system.

* * * * *